United States Patent [19]

Cotter

[11] 4,135,342

[45] Jan. 23, 1979

[54] INSULATED METAL ROOFING AND SIDING SYSTEM

[75] Inventor: Donald P. Cotter, San Francisco, Calif.

[73] Assignee: Field Form, Inc., San Francisco, Calif.

[21] Appl. No.: 845,691

[22] Filed: Oct. 26, 1977

[51] Int. Cl.[2] ..... E04C 1/34

[52] U.S. Cl. ..... 52/461; 52/404

[58] Field of Search ..... 52/404, 588, 461, 406, 52/478

[56] References Cited

U.S. PATENT DOCUMENTS

| | | | |
|---|---|---|---|
| 3,267,626 | 8/1966 | Daly | 52/588 X |
| 3,304,680 | 2/1967 | Birdwell | 52/404 X |
| 3,555,758 | 1/1971 | Schroter | 52/478 X |
| 3,557,507 | 1/1971 | Wilder | 52/404 |
| 3,708,943 | 1/1973 | Thomas et al. | 52/588 |
| 4,001,995 | 1/1977 | Cotter | 52/460 |

*Primary Examiner*—Ernest R. Purser
*Assistant Examiner*—Carl D. Friedman
*Attorney, Agent, or Firm*—Townsend and Townsend

[57] ABSTRACT

An insulated roofing and siding system is disclosed. A plurality of elongate insulation bins are located side by side on the roof or wall of a supporting structure. Each bin has a flat base and vertical side walls defining a cavity in which insulation material can be inserted. A plurality of elongate plates are located over the respective bins, and the edges of the plates snap into incurved portions on the associated bins to enclose the cavities which contain the insulation material. Each plate has an upwardly directed flange at each of its lateral edges having an outwardly directed C-shaped section juxtaposed to adjacent such sections on adjoining plates. A plurality of discrete clips attach the insulation bins and plates to the supporting structure. Battens are snapped over adjacent flanges on contiguous lateral edges of the plates to provide weatherproofing for the roofing and siding system.

11 Claims, 3 Drawing Figures

INSULATED METAL ROOFING AND SIDING SYSTEM

BACKGROUND OF THE INVENTION

The present invention relates to insulated roofing and siding systems.

The rapidly rising costs of building construction, and in particular the labor costs involved in such construction, have greatly intensified the need for building systems which can be installed rapidly and with a minimum amount of field labor.

As discussed in my previous patent, U.S. Pat. No. 4,001,995, a variety of roofing and siding systems have been developed which can be installed in a more or less efficient manner, thereby reducing construction costs. Such roofing and siding systems provide an outer, weather resistant skin for the building structure which is installed over a ceiling or wall and conventional insulation if any. That patent illustrates an improved such system for providing roofing and siding for a building which can be installed in a highly efficient manner, and provides a very effective weatherproof outer covering for the building.

The metal roofing and siding systems known in the art, as typified by my U.S. Pat. No. 4,001,995, are generally installed over a surface cover such as a plywood skin installed on the building before the metal roofing or siding is added. If the building is to be insulated, the insulation is installed beneath the plywood surface cover. Installation of the plywood surface cover and the insulation must be performed by hand in the field, increasing the labor costs involved in constructing the building. In addition, the underside of the insulation must be covered if it is in the public view because the insulation by itself is quite unsightly, further adding to the costs of construction.

The present invention provides an improved roofing and siding system in which the system includes provisions for insulating the supporting structure.

A plurality of elongated insulation bins are located side by side on the roof or wall of the supporting structure. Each bin has a flat base and vertical side walls defining a cavity in which insulation material can be inserted. A plurality of elongate plates are located over the respective bins, and the edges of the plates snap into incurved portions on the associated bins to enclose the cavities which contain the insulation material. Each plate has an upwardly directed flange at each of its lateral edges having an outwardly directed C-shaped section juxtaposed to adjacent such sections on adjoining plates. A plurality of discrete clips attach the insulation bins and plates to the supporting structure. Battens are snapped over adjacent flanges on contiguous lateral edges of the plates to provide weatherproofing for the roofing and siding systems.

This system is easy to install because all of the parts snap together, and only the clips must individually be attached to the supporting structure if such a supporting structure is used. Open insulation bins are provided for the insulation material, and the insulation material is simply poured or otherwise inserted therein. The bins are then enclosed by snapping the cover plates in place. The elements are free to slide longitudinally with respect to one another to allow for differential expansion.

The simplicity with which the system of the present invention can be installed in this field greatly decreases installation costs. The system of the present invention also eliminates the separate step of installing insulation material. Moreover, with the system of the present invention, it is not necessary to install a surface cover on the structure before installing the roofing and siding. Instead, the roofing and siding system of the present invention can be mounted to widely spaced purlins, or in some instances, may even be free standing. The box structure provided by the present invention is far more rigid than prior art roofing and siding systems, and can be used as a structural element, and not merely as a weatherproof skin.

The novel features which are characteristic of the invention, as to organization and method of operation, together with further objects and advantages thereof will be better understood from the following description considered in connection with the accompanied drawings which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
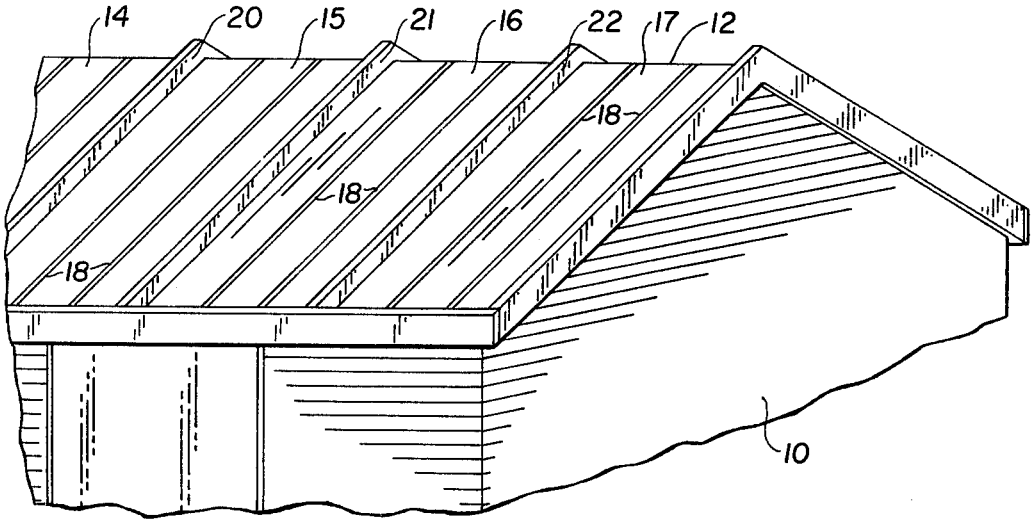
FIG. 1 is a perspective view of a building structure incorporating the roofing and siding system of the present invention.

A building structure 10 employing the system of the present invention to provide roofing 12 for the structure is illustrated by way of reference to FIG. 1. The exposed exterior of roofing 12 includes a plurality of panels 14–17 located side by side and overlying the supporting structure. Panels 14–17 are generally flat, but may be provided with ribs such as 18 to enhance their structural integrity. Panels 14–17 are joined at their edges by battens 20–22, as illustrated in more detail hereinafter, to provide a weatherproof exterior to the supporting structure 10.

Figure 3:
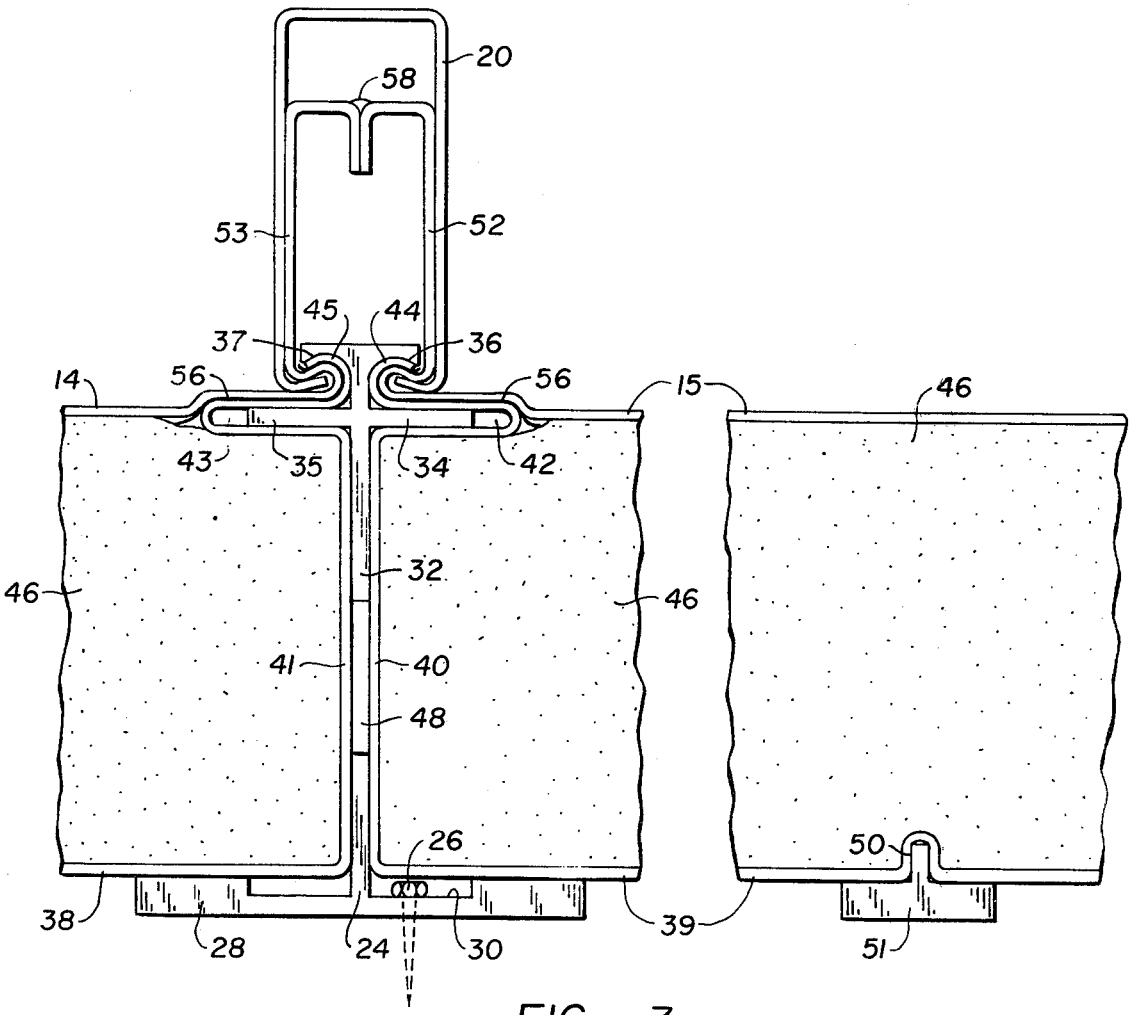
FIG. 3 is a fragmentary side elevation view of the preferred embodiments of the present invention.
Figure 2:
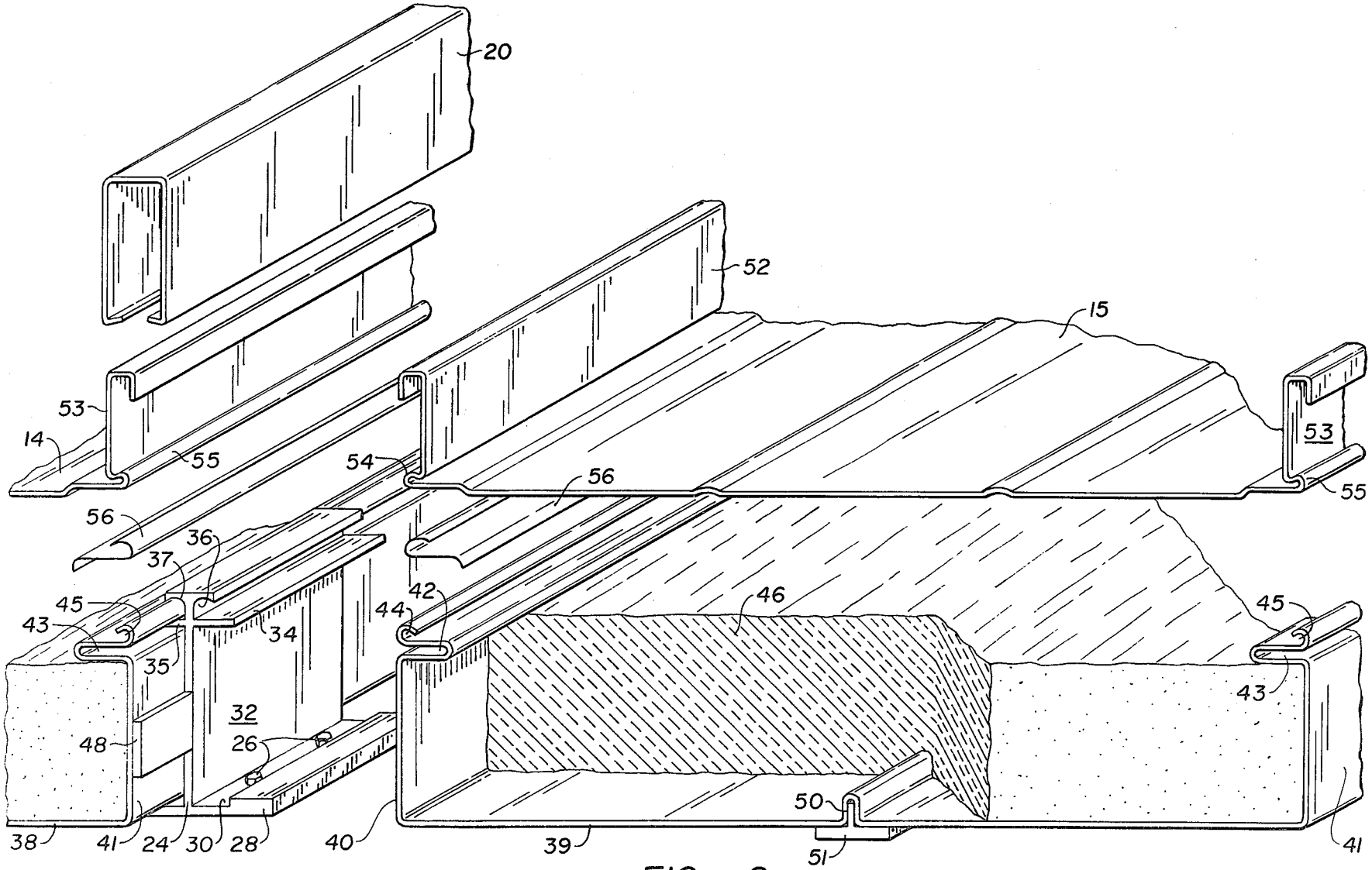
FIG. 2 is an exploded perspective view of the preferred embodiment of the present invention.

The details of the preferred embodiment of the present invention are further illustrated by way of reference to FIGS. 2 and 3. A plurality of clips such as 24 are ordinarily mounted to the supporting structure (not shown) by screws or other appropriate fasteners 26. Clips 24 can be mounted to purlins spaced at intervals in the building structure, and may be widely spaced so that the roofing and siding system is virtually a free standing structure. Each clip 24 includes a base portion 28 having recesses 30 to accommodate screws 26 so the top of the screws are recessed. Each clip 24 further includes an upstanding portion 32, transverse projections 34, 35 and recesses 36, 37 immediately above the transverse projections.

A plurality of insulation bins such as 38, 39 are located side by side on the supporting structure. Each bin 38, 39 includes a generally flat base portion and a pair of vertical sidewalls such as 40, 41 (the details of the bins 38, 39 are given the same reference numerals for clarity). Each side wall 40, 41 has an outwardly opening channel 42, 43 located proximate the upper end of the side wall, and incurved portions 44, 45 at the upper ends. The base and side walls of each insulation bin such as 39 define a cavity in which insulation material such as 46 is inserted. Fiberglass, polyurethane foam, honeycomb and other standard insulation materials can be used.

When insulation bins 38, 39 are located side by side on the supporting structure, clips 24 are interposed between the side walls of adjacent insulation bins. As illustrated in FIG. 3, the side walls of the bins are flush or nearly so with the upstanding members 32 of clips 24. Since the clips are discrete and not continuous, the spacer such as 48 may be used to isolate the side walls of the respective insulation bins along their length.

The outwardly directed flanges 34, 35 of clips 24, are received within the outwardly opening channels 42, 43 of the respective insulation bins. The incurved portions 44, 45 of the insulation bins are received within the outwardly directed recesses 36, 37 of clips 24. The insulation bins are simply snapped in place between the clips and are securely fastened to the supporting structure without the use of convention fasteners such as screws, bolts and the like attached directly to the bins.

Since the base portions of the insulation bins are spaced slightly from the supporting structure, it may be desirable to increase the structural rigidity of the base portions of the insulation bins. Accordingly, downwardly opening grooves such as 50 can be located in the insulation bins, and stud members 51, attached to the supporting structure, used to engage the downwardly opening grooves 50 to further secure the insulation bins to the supporting structure.

Cover plates such as 14, 15 snap into position over the respective insulation bins 38, 39 to enclose the cavities containing insulation material 46. Each plate such as 15 includes a generally flat portion which overlies the associated insulation bin. Along each lateral edge of the plate, upstanding flanges such as 52, 53 are provided which have outwardly directed, C-shaped cross-sections. The lateral edges 54, 55 of each plate such as 15 are adapted to snap within and engage the incurved portions 43, 44 of insulation bin 38, 39, which are in turn engaged within recesses 37, 36 of clip 24. In this manner, each plate 14, 15 is secured to the insulation bins and the supporting structure. A strip 56 of Mylar or other suitable material may be interposed between the cover plates and the insulation bins to avoid direct metal-on-metal contact between them.

When cover plates such as 14, 15 are in position as illustrated in FIG. 3, their adjacent C-shaped flanges are juxtaposed to one another. It is preferred that the upper portions of the flanges extend outwardly slightly more than the lower portions so that the upper portions of the flanges are biased together. If desired, a soldered connection 58 can be made between the C-shaped flanges.

To provide continuous weatherproofing at the junction of the plates 14, 15, battens such as 20 are employed. Battens 20 have a generally rectangular cross-section with a slit at the lower end. Each batten such as 20 is made of resilient material so that it can be opened slightly and slipped over juxtaposed C-shaped flanges 52, 53. Once in position, each batten such as 20 provides weatherproofing between the adjacent flanges 52, 53 of plates 14, 15.

To install the system of the present invention, clips 24 are first fastened to the supporting structure in rows spaced apart by the width of the insulation bins. The insulation bins 38, 39 are then snapped in place between the clips, with the outwardly opening channels 42, 43 engaging the transverse projections 34, 35 on the clips, and the incurved portions 44, 45 being received in recesses 36, 37 of the clips.

With the insulation bins such as 38, 39 in place, insulation material is poured or otherwise dispensed into the open cavities defined by the insulation bins. The insulation material need not be glued or otherwise fastened in place as is necessary with sheet rock and other conventional insulation. Cover plates such as 14–17 snap in place over the insulation bins, the lateral edges 54, 55, thereof being received within the incurved portions 44, 45 of the insulation bins which are in turn located within recesses 36, 37 of clips 24. Battens 20 are snapped over the juxtaposed C-shaped flanges 52, 53 of the respective cover plates to provide a weatherproof outer surface.

When in place, the cover plate and the insulation bins are free to expand longitudinally because they are not rigidly fastened together. Ordinarily, the cover plates are exposed to more extreme temperatures than the underlying insulation bins because of their exposure to the elements, which causes differential expansion with respect to the protected insulation bins. Mylar strips 56 may be used to isolate the cover plates from the insulation bins. Also, clips 24 include a recess 30 so that the fasteners 26 are used to attach the clips to the supporting structure do not directly contact the insulation bins. As a result, the cover plates and the insulation bins are free to expand longitudinally with respect to one another and with respect to the supporting structure without bending, buckling or excessive friction, all of which creates noise which is unacceptable in a habitable structure.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. An insulated roofing and siding system for a supporting structure comprising:

a plurality of elongate insulation bins adapted to be located side by side on the roof or wall of the supporting structure, each said bin including a generally flat base and vertical side walls each defining an outwardly opening channel proximate the upper extremity of the side wall, said insulation bins adapted to receive a quantity of insulation material in the cavity defined by the base and the side walls of each said bin;

a plurality of elongate plates adapted to be located over the respective insulation bins;

a plurality of discrete clips attached to the supporting structure and disposed between adjacent side walls of the various insulation bins, said clips each including an upstanding portion having transverse projections extending therefrom for engaging the channels in adjacent insulation bins to attach the bins to the supporting structure; and a plurality of elongate battens constructed of resilient material, each batten including a slit along the length of said batten so that the batten can extend over adjacent flanges on contiguous lateral edges of two said plates and provide weatherproofing at said edges.

2. A system as recited in claim 1 wherein each batten has a generally rectangular cross-section, one side of each said batten including said slit.

3. A system as recited in claim 1 wherein each of the discrete clips includes a base adapted to be located flush with the supporting structure, said base including at least one recess to accommodate means for attaching the clips to the supporting structure so that said attachment means does not contact the insulation bins.

4. A system as recited in claim 1 and further characterized by an incurved portion in each of said vertical side walls immediately above respective of said outwardly opening channels, each said plate including an upwardly directed flange at each of its lateral edges having an outwardly directed, generally C-shaped section juxtaposed to adjacent such sections as adjoining plates, whereby the edges of each said plate are adapted to snap into the incurved portions of the associated insulation bins to enclose said cavities.

5. An insulated roofing and siding system for a supporting structure comprising:

a plurality of elongate insulation bins adapted to be located side by side on the roof or wall of the supporting structure, each said bin including a generally flat base and vertical side walls each defining an outwardly opening channel proximate the upper extremity of the side wall, said insulation bins adapted to receive a quantity of insulation material in the cavity defined by the base and the side walls of each said bin;

a plurality of elongate plates adapted to be located over the respective insulation bins to enclose said cavities, each said plate including upwardly directed flanges at its lateral edges each having an outwardly directed, generally C-shaped section juxtaposed to adjacent such sections on adjoining plates;

a plurality of discrete clips attached to the supporting structure and disposed between adjacent side walls of the various insulation bins, said clips each including an upstanding portion, transverse projections extending from said upstanding portion and adapted to engage the channels in the adjacent insulation bins to attach said bins to the supporting structure, and outwardly directed recesses proximate the respective transverse projections adapted to receive the lower portions of the flanges of each said plate to attach the plates to the supporting structure; and a plurality of elongate battens constructed of resilient material, each batten including a slit along the length of said batten so that the batten can extend over adjacent flanges on contiguous lateral edges of two said plates and provide weatherproofing at said edges.

6. A system as recited in claim 5 wherein the outwardly directed recesses of the clips are located above and proximate to the transverse projections.

7. A system as recited in claim 6 in which the lower portion of each flange of each said plate nests within the corresponding incurved portion of the associated bin within the recess of the adjacent clip.

8. A system as recited in claim 7 and additionally comprising Mylar strips located between the incurved portions of the insulation bins and the lateral edges of the plates to prevent direct contact between the insulation bins and the plates.

9. A system as recited in claim 5 and additionally comprising at least one downwardly opening groove formed in each of the base portions of the insulation bins, and additionally comprising a stud member attached to the supporting structure and adapted to engage said groove to provide additional support to the insulation bin.

10. A system as recited in claim 5 wherein each batten has a generally rectangular cross section, one side of each said batten including said slit.

11. A system as recited in claim 6 wherein the upper portion of the C-shaped section of each flange extends outwardly more than the lower portion thereof so that when the elongated plates are located over the respective insulation bins, the upper portions of the C-shaped sections adjacent flanges are pressed against one another.

* * * * *